US005327357A

United States Patent [19]

Feinstein et al.

[11] Patent Number: 5,327,357

[45] Date of Patent: Jul. 5, 1994

[54] METHOD OF DECARBURIZING MOLTEN METAL IN THE REFINING OF STEEL USING NEURAL NETWORKS

[75] Inventors: Jonathan J. Feinstein, North Salem; Richard B. Mazzarella, Grand Island; Lanier Stambaugh, Briarcliff Manor, all of N.Y.

[73] Assignee: Praxair Technology, Inc., Danbury, Conn.

[21] Appl. No.: 802,046

[22] Filed: Dec. 3, 1991

[51] Int. Cl.[5] ..... G06F 15/18; G06F 15/46; C21C 7/068; C21D 3/04

[52] U.S. Cl. ..... 364/502; 75/375; 75/380; 75/384; 75/386; 395/904

[58] Field of Search ..... 364/500, 502; 395/21, 395/22, 23, 904, 906; 75/375, 380, 382, 384, 386, 387, 557

[56] References Cited

U.S. PATENT DOCUMENTS 3,754,894 8/1973 Saccomano et al. ..... 75/557
3,816,720 6/1974 Bauer et al. ..... 75/382
4,972,473 11/1990 Ejiri et al. ..... 380/20
5,003,490 3/1991 Castelaz et al. ..... 395/22

*Primary Examiner*—Jack B. Harvey
*Assistant Examiner*—Melanie A. Kemper
*Attorney, Agent, or Firm*—Cornelius F. O'Brien

[57] ABSTRACT

A method of decarburizing molten metal in the refining of steel using neural networks with a first neural network trained to analyze data representative of many process periods of one or more decarburization operations for providing an oxygen count for a preselected gas ratio of oxygen to diluent gas to cause the temperature of the molten metal bath to be decarburized to rise to a specified aim temperature and with a second neural network trained to analyze data representative of many process periods of one or more decarburization operations for providing an output schedule of oxygen counts to be injected into the bath to reduce the carbon level to a predetermined aim level in one or more successive stages corresponding to a preselected schedule of ratios of oxygen to diluent gas.

14 Claims, 4 Drawing Sheets

METHOD OF DECARBURIZING MOLTEN METAL IN THE REFINING OF STEEL USING NEURAL NETWORKS

FIELD OF THE INVENTION

This invention relates to an AOD process for decarburizing molten metal in the refining of steel and more particularly to an AOD process for decarburizing molten metal using neural networks to control the decarburization operation.

BACKGROUND OF THE INVENTION

A process which has received wide acceptance in the steel industry for refining metal is the argon-oxygen decarburization process also referred to as the "AOD" process. It is the purpose of AOD refining to first remove carbon from a bath of metal, next reduce any metals that may have oxidized during decarburization, and finally adjust the temperature and chemistry of the bath before casting the metal into a product. Decarburization is achieved by injecting mixtures of oxygen and inert gases in such a way as to favor the oxidation of carbon over the oxidation of other metal components present in the bath. At progressively lower carbon contents during the process of decarburization progressively greater dilution of the oxygen by inert gases is injected to favor the oxidation or removal of carbon.

Relationships between the bath weight, chemistry, and temperature, the injections of oxygen and inert gases, and the resultant changes in metal chemistry and temperature have been theorized to achieve both control and understanding of how to optimize the economics of the process. Thermodynamic models have tracked the general relationships between these parameters, but have limited accuracy and have not obviated the need for intermediate sampling of the bath temperature and chemistry in processing any given heat of metal. Some theorists have adopted the approach that the decarburization reaction may be better understood, and hence controlled, by considering the chemical kinetics of the competing oxidations of carbon and the various metal species present. It follows that approaches incorporating both thermodynamic and kinetic considerations have also been constructed. Finally, statistical approaches have been used to empirically model decarburization in an AOD converter.

The traditional modeling of the decarburization cycle of the AOD operation requires not only a comprehensive understanding of how to represent the thermodynamics and/or kinetics for use in a computer program, but also requires the knowledge of many properties of the species involved in the reactions. For instance, normal thermodynamic modeling requires the knowledge of at least 25 pertinent interaction coefficients. The free enthalpies and entropies associated with each potential reaction must also be known as well as a representative pressure exerted on the bubbles passing through and reacting with the bath. Kinetic models that are based on assumptions that diffusion, adsorption and desorption rates significantly affect the relative extents to which the competing oxidation reactions occur are similarly dependent on accurate knowledge of these rates with respect to temperature and base composition. They must also be capable of modeling the surface areas, velocities of the bubbles relative to the surrounding liquid, and the residence times of the bubbles in the metal phase. Thus, the modeling of decarburization based on chemical theories is subject to many items of data being all accurately measured. They also require a correct understanding of the mechanisms of the various reactions. Since models are deficient in at least one of these two requirements, it is normal for known physical "constants" to be altered to make the results of the model fit actual results better. Due to the complexity of these models, great skill is required to adjust the parameters to improve the overall accuracy of an entire population of results. Often it is found that one particular solution or combination of adjusted constants is optimal for representing the results of only one particular set of working conditions. That is, solutions tend not to be general, but rather geared to specific small sets of data for which they were adjusted.

In spite of the variety of approaches, inaccuracies remain and some form of measuring the carbon content during the decarburization process step is normally required. This usually necessitates halting the process, withdrawing a metal sample, analyzing the carbon content and measuring the bath temperature before resuming. Lack of process control during decarburization not only necessitates extra sampling, but precludes operation at the optimal conditions for cost reduction and production maximization.

A computerized system using "neural networks" benefits from the fact that a theoretical understanding of decarburization is not required. Knowledge of the physical properties of the species and thermodynamic and kinetic reactions involved is also not required nor are the heat transfer properties of the reactor vessel required. Given the pertinent input parameters, a neural network can evaluate the input data and provide appropriate output data for controlling the decarburization operation based upon the recognition of patterns between the input and output data which it has learned through a learning or training procedure involving the evaluation of random examples presented to the neural network thousands of times.

The processing of a computer to perform parallel distributive processing logic based upon neural models which simulate the operation of the human brain is, in general, referred to as "neural networks". A neural network utilizes numerous nonlinear elements referred to as "neurons" to simulate the function of neurons in a human brain with each neuron representing a processing element. Each processing element is connected to other processing elements through a connecting weight or "synapse" which is combined by summation. The connecting weights are modified by adaptive learning from multiple examples. Once trained, the neural network is capable of recognizing a pattern between the input and output data which may be utilized, as hereinafter explained in detail, to provide information for controlling a decarburization operation without concern for the thermodynamic activity of the constituents in the bath and/or the kinetics of the reactions. The bath represents the mass of molten metal which is transferred to a refractory lined vessel to be refined in accordance with the present invention.

SUMMARY OF THE INVENTION

In its broadest aspects, the present invention is a method for refining steel by controlling the decarburization of a predetermined molten metal bath having a known composition of elements including carbon and having a known or estimated initial temperature and weight at the outset of decarburization of a molten metal bath in a refractory vessel with said process of decarburization performed through the injection of oxygen and a diluting gas into said bath under adjustable conditions of gas flow, comprising the steps of:

(a) training a first neural network to analyze input and output data representative of many process periods of one or more decarburization operations, from data including the bath chemistry, weight and temperature at the outset of each process period, the gas ratio of oxygen to diluent gas used during each process period, the counts of oxygen injected into the bath for each process period, and the final temperature obtained at the conclusion of each process period, until said first neural network is able to provide a substantially accurate output representing the counts of oxygen required to be injected into said predetermined bath at any preselected gas ratio to cause the temperature of the bath to rise to a specified aim temperature level as a result of such gas injection;

(b) training a second neural network to analyze input and output data representative of many process periods of one or more decarburization operations, from data including the bath chemistry, weight and temperature at the outset of the process period, the gas ratio of oxygen to diluent gas used during each process period, the counts of oxygen injected into the bath for each process period and the final carbon content obtained at the conclusion of each process period until the second neural network is able to provide a substantially accurate output schedule of oxygen counts to be injected into said predetermined bath to reduce the carbon level to a predetermined aim level in one or more successive stages corresponding to a preselected schedule of ratios of oxygen to diluent gas;

(c) employing said first neural network to compute the oxygen counts to be injected into said predetermined bath, from its known initial chemistry, weight and temperature at a first preselected ratio of oxygen to diluent gas to raise the bath temperature to a specified aim temperature level;

(d) injecting oxygen and diluent gas into said bath at said first preselected ratio until the oxygen counts computed by said first neural network are satisfied;

(e) employing said second neural network to provide an output schedule of oxygen counts to be injected into the bath from its known initial chemistry, weight and temperature to successively reduce the carbon level in said bath to a predetermined aim carbon level in one or more stages corresponding to a preselected schedule of ratios of oxygen to diluent gas; and (f) injecting oxygen and diluent gas into said bath at said preselected schedule of oxygen counts corresponding to said output schedule as computed by said second neural network.

BRIEF DESCRIPTION OF THE DRAWINGS

Further advantages of the present invention will become apparent from the following detailed description of the invention when read in conjunction with the accompanying drawings of which.

DESCRIPTION OF A PREFERRED EMBODIMENT

Figure 1:
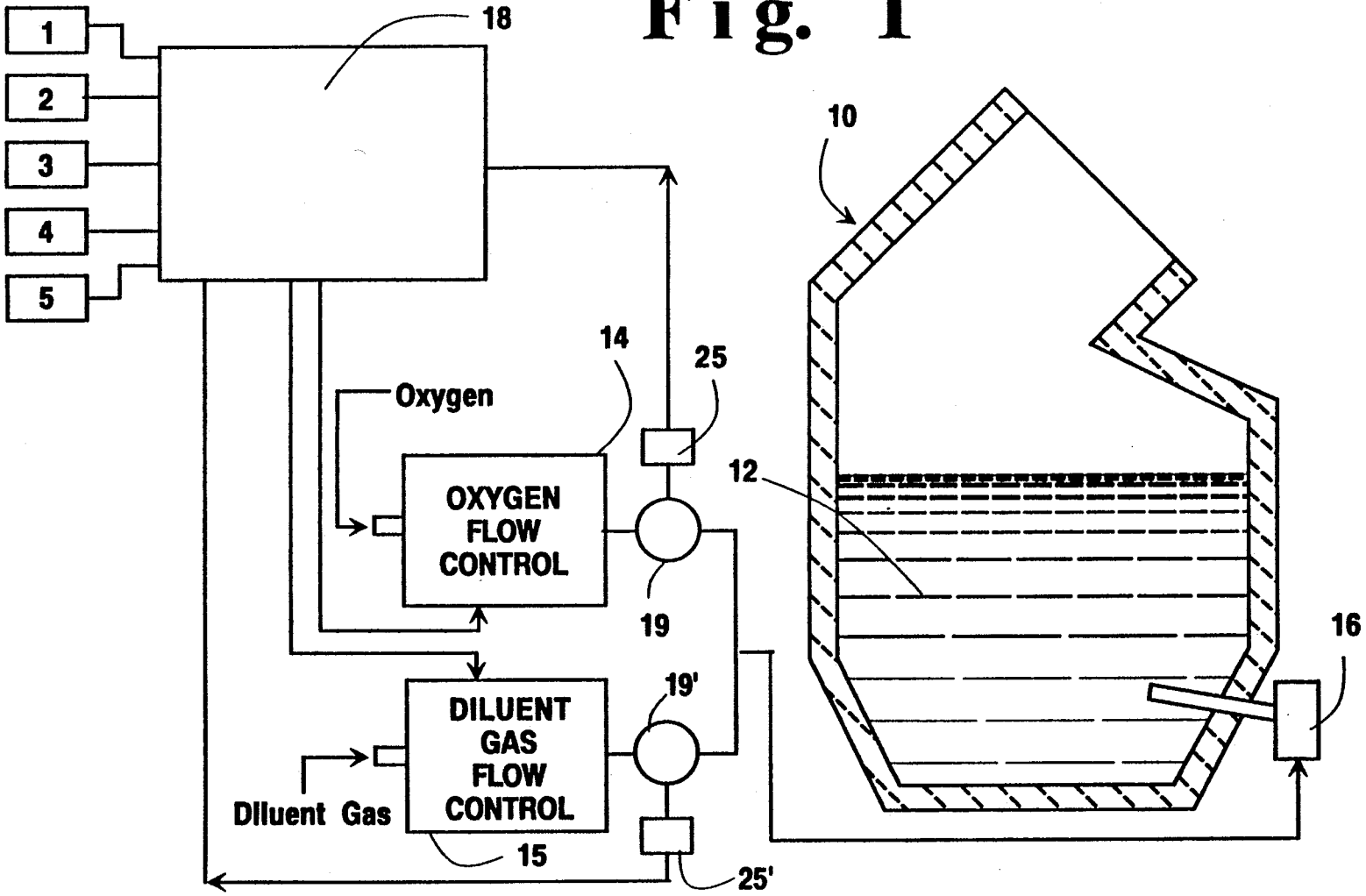
FIG. 1 is a general schematic diagram of a decarburization system which utilizes the present invention.

The decarburization system as shown in FIG. 1 includes a refractory lined vessel 10 charged with a predetermined mass of molten metal 12 having a known composition including carbon and other alloying constituents such as chromium, nickel, manganese, silicon, iron and molybdenum in the production of steel particularly stainless steel, or nickel or cobalt based alloys. The weights of the liquid metal charged into the vessel is measured or estimated. The weight of solid additions, if any, are independently computed, using conventional methods well known to those skilled in the art, to adjust the bath chemistry and weight to desired levels. Also the initial bath temperature is either estimated or measured. Conventional apparatus is available to weigh the liquid metal charged into the vessel and to measure the temperature of the bath.

The flow of oxygen from a source (not shown) is regulated by a conventional oxygen flow controller 14. Likewise, the flow of diluting gas from a source (not shown) is regulated by a conventional gas flow controller 15. The gases are combined and injected directly into the melt 12 through a conventional tuyere assembly 16 or another suitable gas injector.

Following decarburization the molten metal bath is reduced, finished and tapped with all of the finishing steps, including reduction, practiced in a conventional manner. The method of decarburization is achieved in accordance with the present invention by the injection of oxygen and diluent gas, preferably subsurfacely, alone or in combination with a supply of oxygen and/or a diluent gas blown from above the bath. Alternatively, all oxygen and diluent gas, if any, may be blown onto the bath from above its surface. The diluent gas may be selected from the group consisting of argon, nitrogen and carbon dioxide. The metal bath is heated through the exothermic oxidation reactions which take place during decarburization. If extra heat is needed, solid additions are added to the molten bath generally through the addition of aluminum and/or silicon with oxygen subsequently supplied to the bath to oxidize those additions. The control of the slag chemistry is independent of the present invention.

The heat or bath of molten metal is generally blown at the maximum gas flow rate obtainable for the refining vessel and heat size which is roughly 500 to 4,000 cubic feet per hour of total gas flow per ton of metal refining capacity for an AOD vessel and keeping the ratio of oxygen flow rate to the flow rate of diluent gas relatively high, preferably between 3:1 and 10:1, until the refractory is threatened by high temperature. A given amount of oxygen injected into the vessel is defined for purposes of the present invention as a count of oxygen or oxygen "count". Likewise, a given amount of argon or other diluent gas to be injected into the vessel is defined as a "count" of diluent gas.

Figure 5:
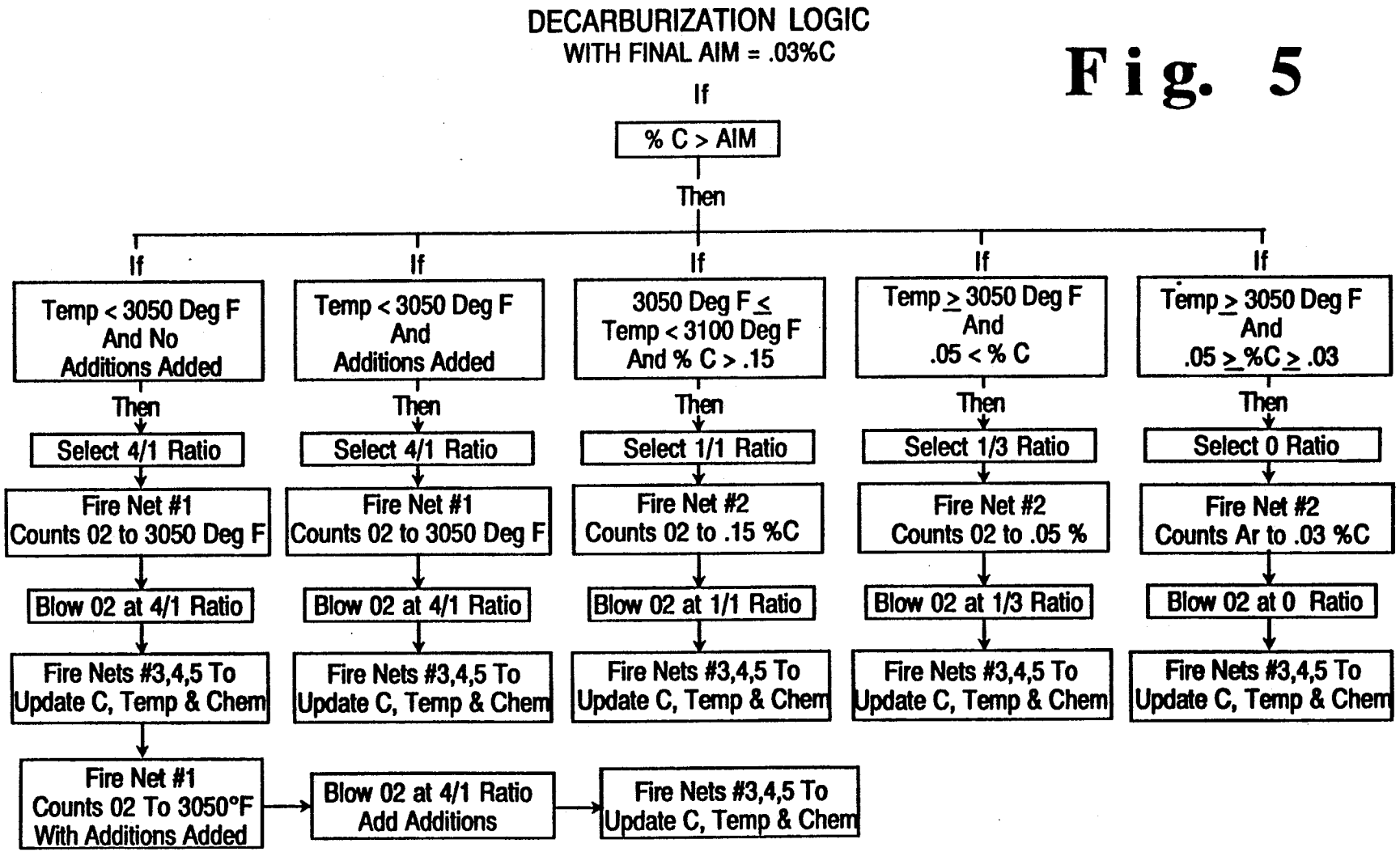
FIG. 5 is the preferred decarburization logic for the carrying out the process of decarburization in accordance with the present invention.

A set of flowmeters 19 and 19' and a set of integrators 25 and 25' are used to measure the counts of oxygen and diluent gases injected into the bath 12. The ratio of oxygen to diluent gas is controlled by adjusting the flow of each gas through their respective flow controllers which can be manually or automatically adjusted under the direction of the computer 18. The computer 18 is programmed to perform the decarburization logic as outlined in FIG. 5 in conjunction with the selective operation of a plurality of neural networks numbered 1-5, respectively. At least two neural networks are required in the performance of the present invention although the use of five (5) neural networks is preferred as will be explained in greater detail hereinafter.

Figure 2:
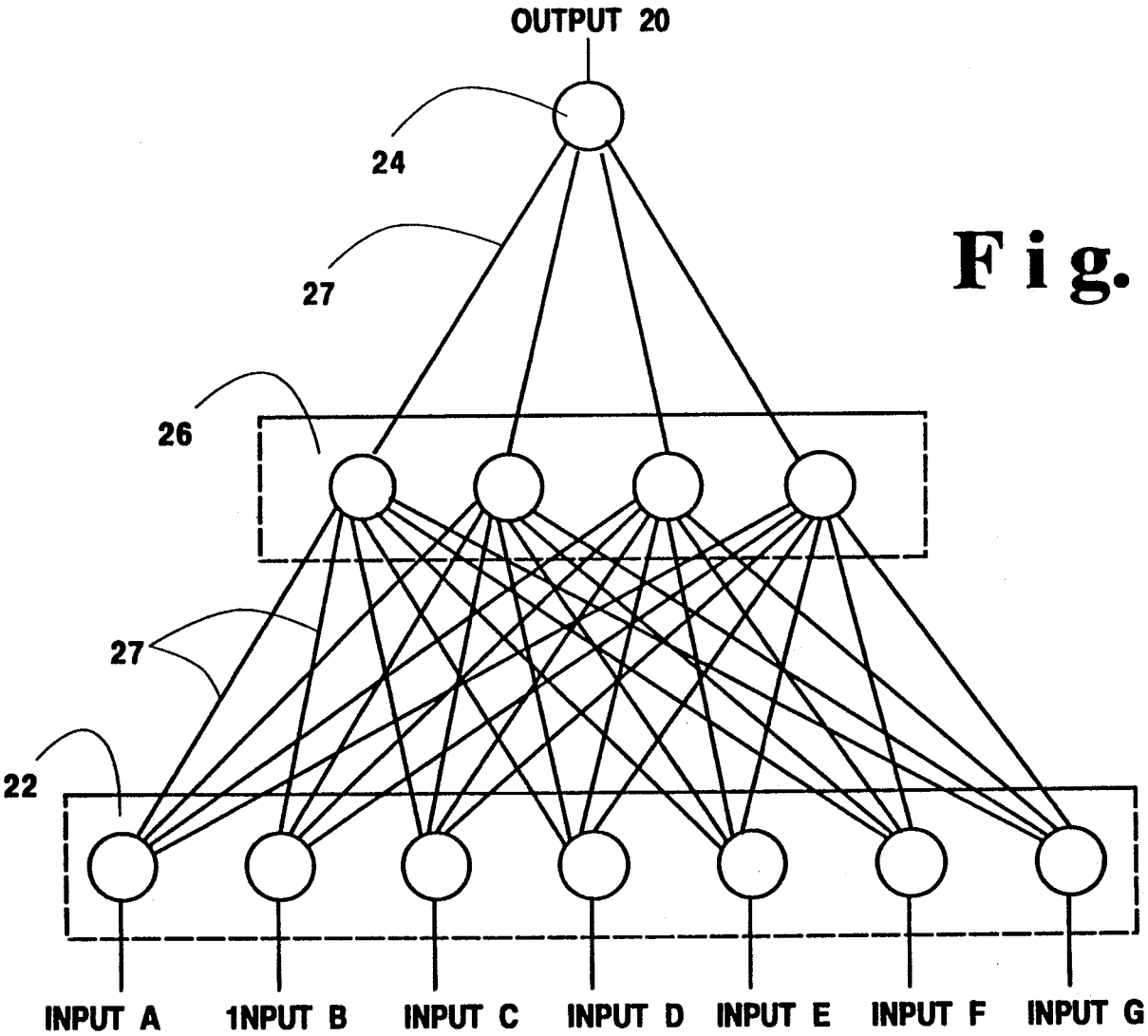
FIG. 2 is a schematic diagram of the type of neural network used in the present invention.

A schematic representation of a typical neural network is shown in FIG. 2 and comprises a layer of input processing units or "neurons" connected to other layers of similar neurons through weighted connections or "synapses" in accordance with the particular neural network model employed. The neural network internally develops algorithms of its own based on adjustments of the weighted connections through training.

The first or input layer of neurons is referred to as the input neurons 22, whereas the neurons in the last layer are called the output neurons 24. The input neurons 22, and the output neurons 24 may be constructed from sequential digital simulators or a variety of conventional digital or analog devices such as, for example, operational amplifiers. Intermediate layers of neurons are referred to as inner or hidden neuron layers 26. While only four hidden neurons are shown in a single hidden layer 26 in FIG. 2, it will be understood that a substantially greater or lesser number of neurons and/or greater number of layers of hidden neurons may be employed depending on the particular function assigned to such neural network. Each neuron in each layer is connected to each neuron in each adjacent layer. That is, each input neuron 22 is connected to each inner neuron 26 in an adjacent inner layer. Likewise, each inner neuron 26 is connected to each neuron in the next adjacent inner layer which may comprise additional inner neurons 26. As shown in FIG. 2, the next layer may comprise the output neurons 24. Each neuron of the output layer is connected to each neuron in the previous adjacent inner layer.

Each of the connections 27 between neurons contain weights or "synapses" (only some of the connections 27 are labeled in FIG. 2 to avoid confusion; however, numeral 27 is meant to include all connections 27). These weights may be implemented with digital computer simulators, variable resistances, or with amplifiers with variable gains, or with field effect transistor (FET) connection control devices utilizing capacitors and the like. The connection weights 27 serve to reduce or increase the strength of the connections between the neurons. While the connection weights 27 are shown with single lines, it will be understood that two individual lines may be employed to provide signal transmission in two directions, since this will be required during the training procedure. The value of the connection weight 27 may be any positive or negative value. When the weight is zero there is no effect in the connection between the two neurons.

The input neurons 22, inner neurons 26 and output neurons 24 each comprise similar processing units which have one or more inputs and produce a single output signal. In accordance with the preferred embodiment, a conventional back propagation training algorithm is employed. Alternatively, other equivalent learning paradigms as known to those skilled in the art may be used. Back propagation requires that each neuron produce an output that is a continuous differentiable nonlinear or semi-linear function of its input. It is preferred that this function, called a transfer function, be a sigmoid logistic non-linear function of the general form:

$$Y_i = \frac{1}{1 + e^{-[\Sigma(W_j \cdot X_j) + \theta]}} \tag{1}$$

Where $Y_i$ is the output of neuron i, $\Sigma(w_j \cdot x_j)$ is the sum of the inputs to neuron i from the previous layer of neurons j, $x_j$ is the output of each neuron j in the previous layer to neuron i, $w_j$ is the weight associated with each synapse connecting each neuron j in the previous layer to neuron i, and $\theta$ is a bias similar in function to a threshold. The derivative of this function $Y_i$ with respect to its total input, $NET_i = \Sigma[(w_j \cdot x_j) + \theta]$ is given by $$\frac{\partial Y_i}{\partial NET_i} = Y_i \cdot (1 - Y_i) \tag{2}$$

Thus, the requirement that the output is a differentiable function of the input is met. Other transfer functions could be used such as the hyperbolic tangent and the like.

Figures 3, 4:
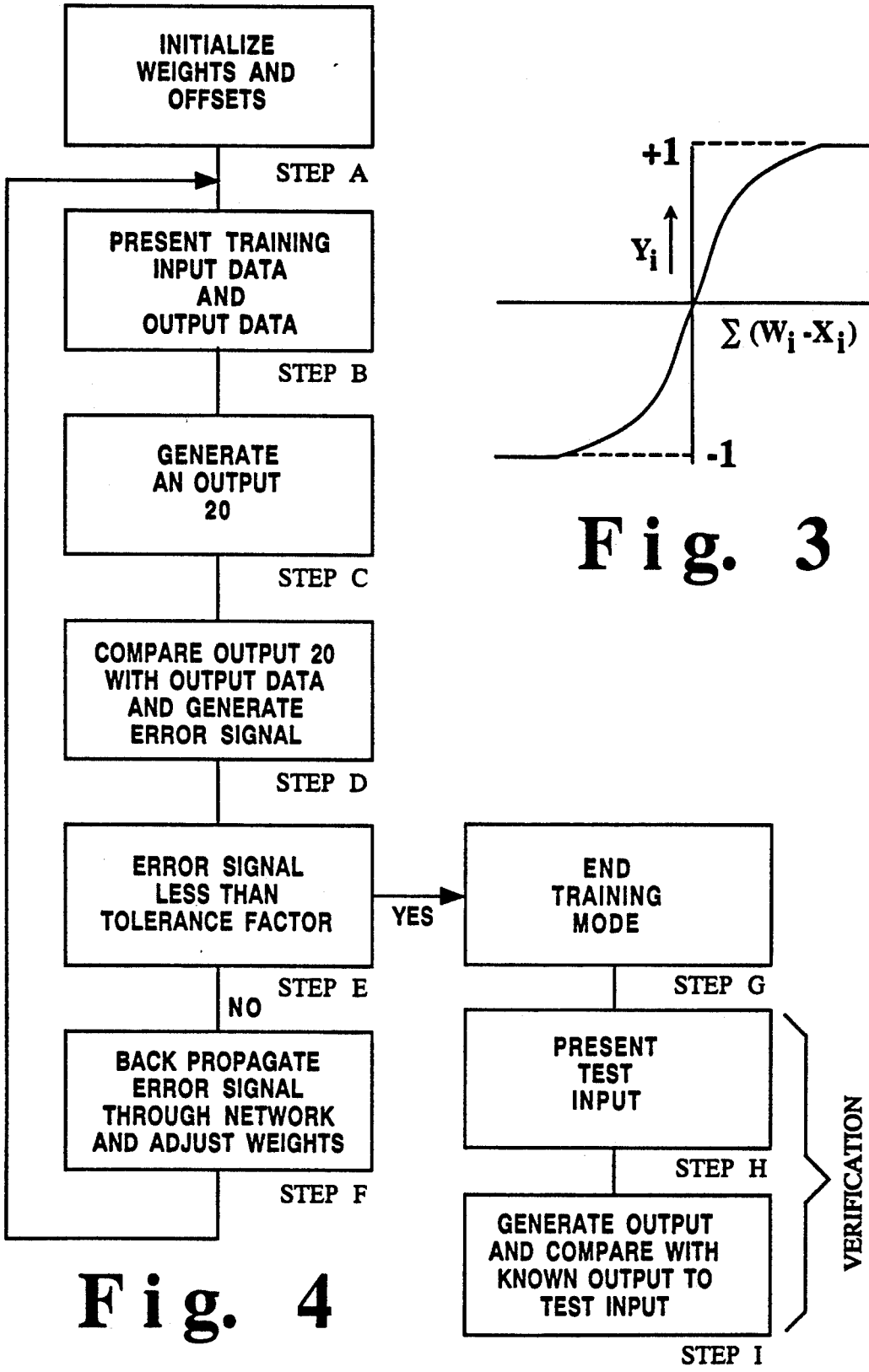
FIG. 3 illustrates the preferred type of transfer function used in training the neural network of FIG. 2 in accordance with the training technique of FIG. 4.
FIG. 4 is a flowchart of the training technique for training a neural network in accordance with the present invention.

The process of training a neural network to accurately calculate outputs involves adjusting the connection weights of each synapse 27 in a repetitive fashion based on known inputs until an output is produced in response to a particular set of inputs which satisfies the training criteria or tolerance factor as exemplified in FIG. 4, step E.

During training, the transfer function $Y_i$ remains the same for each neuron but the weights 27 are modified. Thus, the strengths of connectivity are modified as a function of experience. The weights 27 are modified according to $$\Delta W_j - \eta \delta_i W_j \tag{3}$$

where $\Delta W_j$ is the incremental adjustment to the existing weight $w_j$, $\delta_i$ is an error signal available to the neuron, and $\eta$ is a constant of proportionality also called the learning rate.

The determination of the error signal $\delta_i$ is a recursive process that is propagated backward from the output neurons. First, input values are transmitted to the input neurons 22. This causes computations in accordance with Equation 1 or those of a similar transfer function to be transmitted through the neural network of FIG. 2 until an output value is produced. It should be noted from FIG. 3 that the transfer function $Y_i$ cannot reach the extreme limits of minus one or plus one without infinitely large weights. The calculated output of each output neuron 24 is then compared to the output desired or known to be correct from the training data. For output neurons the error signal is $$\delta_i = (D_i - Y_i) \frac{\partial Y_i}{\partial NET_i} \tag{4}$$

where $D_i$ is the desired output of the given output neuron. By substituting Equation 2 into Equation 4 using the sigmoid transfer function the error signal for output neurons i can be restated as follows:

$$\delta_i=(D_i-Y_i)(Y_i)(b\ 1-Y_i) \quad (5)$$

For hidden neurons 26 there is no specific desired output from the measured data, so the error signal is determined recursively in terms of the error signals in the output or successive hidden layer neurons k to which the hidden layer neurons directly connect and the weights of those connections. Thus, for non-output neurons $$\delta_i=Y_i(1-Y_i)\Sigma(\delta_k \cdot W_k) \quad (6)$$

where $\delta_k$ is the error signal of respective output or successive hidden layer neurons k to which the hidden neuron i is connected and $W_k$ is the weight between that neuron k and the hidden neuron i.

From Equation 3 it can be seen that the learning rate $\delta$ will affect how greatly the weights are changed each time the error signal $\eta$; is propagated. The larger n, the larger the changes in the weights and the faster the learning rate. If, however, the learning rate is made too large the system can oscillate during learning. Oscillation can be avoided even with large learning rates by using a momentum term $\alpha$. Thus, $$\Delta W_{i,n+1}=\eta\delta_i Y_i+\alpha\Delta W_{i,n} \quad (7)$$

may be used in place of Equation 3 where $\Delta W_{i,n+1}$ is the present adjustment of $W_i$ and $\Delta W_{i,n}$ is the previous adjustment of $W_i$.

The constant $\alpha$ determines the effect of past weight changes $\Delta Wi_{i,n}$ on the current direction of movement in weights $\Delta W_{i,n+1}$ providing a kind of momentum in weights that effectively filters out high frequency oscillation in the weights.

Training is accomplished by first collecting sets of input and output data from many actual decarburization operations to be presented as training data in random order to the neural networks. Data is collected defining the initial contents of the chemical constituents of a molten metal bath, the initial bath temperature and weight, the weights of the solid additions added during the blow period, the ratio of oxygen to diluent gas blown and the final temperature obtained whereas output data includes the counts of oxygen and diluent gas injected into the bath. Examples of solid additions used during decarburization are the fluxes such as lime, dolomitic lime or magnesia, the base material used as a source of iron units in the case of ferrous metal refining, cobalt units in the case of cobalt base metal refining or nickel units in the case of nickel based metal refining, ferro-chrome, ferro-manganese, nickel and ferro-nickel. The parameter to be used as the inputs and the parameter to be used as the outputs for each of the neural networks will vary based upon the function of the network.

Each of the neural networks 1 to 5 are assigned different functions and are trained to recognize and identify the requirements needed to perform such functions during the decarburization operation. For example, the first neural network 1 is assigned the function of determining the gas, injection requirements, i.e. the counts of oxygen at a preselected ratio of oxygen to diluent gas to reach a specified bath temperature from the initial chemistry, temperature and weight of the bath 12 charged in the vessel 10. The second neural network 2 may be assigned the function of determining the gas injection requirements to reach a specified carbon content from the initial chemistry, temperature and weight of the bath 12 charged in the vessel 10 using a preestablished gas ratio schedule.

A third neural network may be assigned the function of determining the carbon content in the molten metal bath after the gases have been injected in satisfaction of the computation of either of the first two neural networks. The fourth neural network is assigned the function of computing the bath temperature and the fifth neural network computes the silicon, manganese, chromium, nickel, and molydenum contents of the bath at the completion of the injection of oxygen for the preestablished ratio of oxygen to diluent gas in accordance with either neural network 1 or 2 based upon the input data of the initial bath chemistry, temperature and weight, the counts of oxygen injected and the ratio of oxygen to diluent gas used. The input data of initial conditions may represent either the initial conditions when the molten metal is transferred to the refining vessel or the initial conditions existing at the commencement of any process period i.e, blow period within a decarburization operation as will be explained hereafter in greater detail. Thus the neural networks 1–2 provide the decarburization oxygen counts required to decarburize the molten metal bath pursuant to the decarburization logic of FIG. 5. The computer 18 follows the logic requirements of FIG. 5 in performing the decarburization operation in compliance with the computation of the neural networks 1–2 respectively.

For purposes of the subject invention neural network 1 is used to determine the amount of oxygen required to be injected into the bath to reach a specified aim temperature level and has ten respective input neurons 22 for the initial conditions including the initial carbon, silicon, manganese, chromium, nickel and molybdenum contents of the bath, the initial temperature and weight of the bath, the specified aim temperature of the bath and the ratio of oxygen to diluent gas to be used. An additional six input neurons are used for the weights of each of six types of solid additions which may be added during the blow period as hereinabove identified. Thus neural network 1 is constructed of sixteen input neurons 22, one output neuron 24 for indicating the counts of oxygen required to reach the specified aim temperature level and eight hidden or inner neurons 26 in a single layer.

Neural network 2 is used to determine the amount of oxygen required to reach a specified carbon content, and similarly to network 1, has ten input neurons 22 for the initial carbon, silicon, manganese, chromium, nickel and molybdenum constituents of the bath, the initial bath temperature and weight, the desired aim carbon content and the ratio of oxygen to diluent gas. An additional six input neurons are used for the six solid addition types which may be added during the blow period. Thus neural network 2 is constructed of sixteen input neurons 22 and one output neuron 24 for indicating the counts of oxygen required to reach the specified aim carbon content and has eight hidden or inner neurons 26 in a single layer.

Neural network 3 is used to determine the carbon content reached by injecting a specified amount of oxygen at a specified ratio of oxygen to diluent gas into known initial bath conditions and has respective input neurons 22 for the initial carbon, silicon, manganese, chromium, nickel and molybdenum contents of the bath, the initial bath temperature and weight, the specified amounts of oxygen and diluent gases injected, and the ratio of oxygen to diluent gas blown and the weights of each of the addition types added during the blow period. A network with six types of additions is thus constructed of seventeen input neurons. The network has one output neuron for the carbon content resulting from the specified gas injection and has nine hidden neurons in a single layer.

Neural network 4 is used to determine the temperature reached by injecting a specified amount of oxygen at a specified ratio of oxygen to diluent gas into known initial bath conditions and has respective input neurons 22 for the initial carbon, silicon, manganese, chromium, nickel and molybdenum contents of the bath, the bath temperature and weight, the weights of each of the addition types added during the blow period, the specified amounts of oxygen and diluent gases injected, the elapsed time, and the ratio of oxygen to diluent gas blown. A network with six types of additions is thus constructed of eighteen input neurons. The network has one output neuron for the temperature resulting from the specified gas injection and has nine hidden neurons in a single layer.

Neural network 5 is used to determine the silicon, manganese, chromium, nickel, and molybdenum contents of the bath following the injection of specified amounts of oxygen and diluent gases at a specified ratio of oxygen to diluent gas into known initial bath conditions. Neural network 5 has respective input neurons for the initial carbon, silicon, manganese, chromium, nickel and molybdenum contents of the bath, the bath temperature and weight, the weights of each of the addition types added during the blow period, the specified amounts of oxygen and diluent gases injected and the ratio of oxygen to diluent gas blown. A network with six types of additions is thus constructed of seventeen input neurons. The network has five output neurons for the silicon, manganese, chromium, nickel, and molybdenum contents, respectively, resulting form the specified gas injection and has eleven hidden neurons in a single layer.

Although a single-layer of hidden neurons is used, it is within the scope of the present invention to use a greater or lesser number of hidden layers of neurons. The exact configuration is best established empirically. This applies to the number of hidden neurons within a hidden layer and the number of hidden layers chosen for each of the neural networks.

Input and output data from many actual decarburization operations are used to train the neural networks with data separately collected to correspond to multiple process periods in each decarburization operation. Data is collected for each process period in which only one discreet ratio of oxygen to diluent gas is injected at any time in a single process period. A process period is herein defined as the time between two consecutive samples of bath chemistry and temperature for a given decarburization operation, i.e., within a single heat. The time interval between samples may be short or long in a random relationship. Thus the process periods have no defined time relationship or chronology. Pure diluent gas stirring may also be performed or the vessel may be idle during portions of the process period or additions may be added at any time concurrent with any of these events during process periods from which the data is collected for purposes of training the neural networks. The data should be collected in such a way that the ranges of useful or expected input and output values are represented. For instance, for AOD refining it is best to have initial carbon contents of from 0.1% to 1.8% in the molten metal as initial conditions for various process periods and have data for process periods using oxygen to diluent gas ratios from 4 to 1 to ratios of 1 to 3. Pure diluent gas decarburization data would also be needed to accurately model a practice which uses this technique. Preferably, at least 10 process periods of data should be collected at each oxygen to diluent gas ratio, although the accuracy of the neural network is enhanced by greater amounts of data.

An example of a block of input and output training data for the neural networks 1–5 is set forth in the following Table:

TABLE

| RATIO | ELAPSED TIME | COUNTS 02 | COUNTS N2 | COUNTS AR | INITIAL TEMP °F. | INITIAL % C | INITIAL % Si | INITIAL % CR | INITIAL % MN |
|---|---|---|---|---|---|---|---|---|---|
| 0.000 | 4.000 | 0.000 | 64.000 | 39.000 | 2884.00 | 1.300 | 0.250 | 19.680 | 0.620 |
| 3.000 | 8.000 | 209.000 | 81.000 | 0.000 | 2792.000 | 1.240 | 0.240 | 19.630 | 0.640 |
| 3.000 | 9.000 | 300.000 | 130.000 | 0.000 | 2942.000 | 1.080 | 0.090 | 19.480 | 0.600 |
| 1.000 | 15.000 | 344.000 | 370.000 | 0.000 | 2947.000 | 0.800 | 0.080 | 17.920 | 1.330 |
| 3.000 | 10.000 | 412.000 | 143.000 | 0.000 | 2751.000 | 1.200 | 0.170 | 19.240 | 0.610 |
| 0.000 | 6.000 | 0.000 | 67.000 | 0.000 | 2982.000 | 0.680 | 0.090 | 18.660 | 0.560 |
| 3.000 | 11.000 | 299.000 | 142.000 | 0.000 | 2778.000 | 0.650 | 0.100 | 17.360 | 1.420 |
| 1.000 | 12.000 | 243.000 | 272.000 | 0.000 | 2952.000 | 0.450 | 0.100 | 16.800 | 1.160 |
| 0.000 | 4.000 | 0.000 | 57.000 | 0.000 | 2849.000 | 0.160 | 0.210 | 18.770 | 0.610 |
| 3.000 | 11.000 | 406.000 | 134.000 | 0.000 | 2770.000 | 1.120 | 0.190 | 18.780 | 0.610 |
| 0.000 | 5.000 | 0.000 | 74.000 | 0.000 | 2997.000 | 0.620 | 0.100 | 18.250 | 0.550 |
| 3.000 | 11.000 | 398.000 | 165.000 | 0.000 | 2690.000 | 0.680 | 0.110 | 17.150 | 1.370 |
| 1.000 | 8.000 | 147.000 | 173.000 | 0.000 | 2980.000 | 0.390 | 0.090 | 16.390 | 1.060 |
| 0.333 | 23.000 | 106.000 | 209.000 | 116.000 | 3037.000 | 0.200 | 0.090 | 16.180 | 1.020 |
| 0.000 | 5.000 | 0.000 | 68.000 | 0.000 | 2772.000 | 1.440 | 0.260 | 18.270 | 0.550 |
| 4.000 | 12.000 | 465.000 | 139.000 | 0.000 | 2680.000 | 1.390 | 0.230 | 18.400 | 0.560 |
| 0.000 | 9.000 | 0.000 | 88.000 | 0.000 | 2971.000 | 0.940 | 0.070 | 18.040 | 0.510 |
| 3.000 | 14.000 | 456.000 | 188.000 | 0.000 | 2703.000 | 1.030 | 0.090 | 17.280 | 1.750 |
| 1.000 | 9.000 | 185.000 | 204.000 | 0.000 | 2972.000 | 0.550 | 0.080 | 16.750 | 1.470 |
| 4.000 | 4.000 | 34.000 | 111.000 | 0.000 | 2829.000 | 1.550 | 0.170 | 19.070 | 0.540 |
| 4.000 | 11.000 | 331.000 | 144.000 | 0.000 | 2769.000 | 1.520 | 0.130 | 18.860 | 0.540 |
| 0.000 | 5.000 | 0.000 | 54.000 | 0.000 | 2844.000 | 1.390 | 0.180 | 18.730 | 0.570 |
| 4.000 | 11.000 | 362.000 | 122.000 | 0.000 | 2752.000 | 1.240 | 0.170 | 18.710 | 0.580 |
| 3.000 | 6.000 | 194.000 | 91.000 | 0.000 | 2943.000 | 0.850 | 0.170 | 18.450 | 0.540 |
| 3.000 | 6.000 | 157.000 | 77.000 | 0.000 | 2860.000 | 0.720 | 0.080 | 16.980 | 1.560 |

TABLE-continued

| | | | | | | | | | |
|---|---|---|---|---|---|---|---|---|---|
| 1.000 | 5.000 | 91.000 | 112.000 | 0.000 | 2947.000 | 0.540 | 0.080 | 16.860 | 1.560 |
| 0.333 | 39.000 | 356.000 | 759.000 | 149.000 | 2977.000 | 0.410 | 0.080 | 16.690 | 1.540 |
| 0.000 | 5.000 | 0.000 | 55.000 | 0.000 | 2840.000 | 1.210 | 0.300 | 18.650 | 0.660 |
| 4.000 | 11.000 | 454.000 | 142.000 | 0.000 | 2746.000 | 1.200 | 0.300 | 18.650 | 0.660 |
| 0.000 | 12.000 | 0.000 | 207.000 | 0.000 | 3060.000 | 0.690 | 0.300 | 18.650 | 0.660 |
| 3.000 | 13.000 | 458.000 | 184.000 | 0.000 | 2546.000 | 0.690 | 0.100 | 17.530 | 1.390 |
| 1.000 | 9.000 | 191.000 | 215.000 | 0.000 | 2942.000 | 0.530 | 0.070 | 16.550 | 1.090 |
| 0.000 | 5.000 | 0.000 | 72.000 | 0.000 | 2826.000 | 1.580 | 0.120 | 19.020 | 0.600 |

| RATIO | INITIAL % Ni | INITIAL % Mo | INITIAL METAL WEIGHT lbs | ADDITION BASE lbs. | ADDITION FeMn lbs | ADDITION 37 FeNi lbs | ADDITION Ni lbs | ADDITION FeCr lbs |
|---|---|---|---|---|---|---|---|---|
| 0.000 | 6.340 | 0.26 | 109333 | 0 | 0 | 0 | 0 | 0 |
| 3.000 | 6.370 | 0.25 | 109202 | 0 | 0 | 0 | 0 | 0 |
| 3.000 | 6.400 | 0.25 | 109700 | 2847 | 1333 | 2670 | 0 | 0 |
| 1.000 | 6.970 | 0.26 | 114794 | 0 | 0 | 0 | 0 | 0 |
| 3.000 | 6.460 | 0.13 | 101000 | 0 | 0 | 0 | 0 | 0 |
| 0.000 | 6.560 | 0.13 | 99808 | 5283 | 1270 | 2653 | 0 | 0 |
| 3.000 | 6.900 | 0.13 | 109985 | 0 | 0 | 0 | 0 | 0 |
| 1.000 | 6.990 | 0.13 | 108157 | 0 | 0 | 0 | 0 | 0 |
| 0.000 | 6.970 | 1.56 | 99667 | 0 | 0 | 0 | 0 | 0 |
| 3.000 | 6.970 | 1.61 | 99607 | 0 | 0 | 0 | 0 | 0 |
| 0.000 | 7.050 | 1.58 | 98491 | 5193 | 1317 | 2673 | 1213 | 913 |
| 3.000 | 8.370 | 1.55 | 109798 | 0 | 0 | 0 | 0 | 0 |
| 1.000 | 8.460 | 1.57 | 108623 | 0 | 0 | 0 | 0 | 0 |
| 0.333 | 8.490 | 1.56 | 108189 | 0 | 0 | 0 | 0 | 0 |
| 0.000 | 3.870 | 0.19 | 106100 | 0 | 0 | 0 | 0 | 0 |
| 4.000 | 3.850 | 0.19 | 106015 | 0 | 0 | 0 | 0 | 0 |
| 0.000 | 3.920 | 0.20 | 105093 | 0 | 1787 | 3547 | 3390 | 1177 |
| 3.000 | 7.860 | 0.21 | 114993 | 0 | 0 | 0 | 0 | 0 |
| 1.000 | 7.960 | 0.21 | 113820 | 0 | 0 | 0 | 0 | 0 |
| 4.000 | 6.590 | 0.36 | 102667 | 0 | 0 | 0 | 0 | 0 |
| 4.000 | 6.660 | 0.36 | 102379 | 0 | 0 | 0 | 0 | 0 |
| 0.000 | 4.280 | 0.34 | 101667 | 0 | 0 | 0 | 0 | 0 |
| 4.000 | 4.290 | 0.35 | 101484 | 0 | 0 | 0 | 0 | 0 |
| 3.000 | 4.290 | 0.35 | 100824 | 367 | 1793 | 2937 | 3390 | 190 |
| 3.000 | 7.000 | 0.36 | 109271 | 0 | 0 | 0 | 0 | 0 |
| 1.000 | 7.040 | 0.36 | 108943 | 0 | 0 | 0 | 0 | 0 |
| 0.333 | 7.060 | 0.36 | 108616 | 0 | 0 | 0 | 0 | 0 |
| 0.000 | 3.550 | 2.10 | 96333 | 0 | 0 | 0 | 0 | 0 |
| 4.000 | 3.550 | 2.08 | 96324 | 0 | 0 | 0 | 0 | 0 |
| 0.000 | 3.550 | 2.08 | 95832 | 0 | 1290 | 9363 | 2397 | 3135 |
| 3.000 | 8.400 | 2.07 | 111824 | 0 | 0 | 0 | 0 | 0 |
| 1.000 | 8.530 | 2.07 | 110516 | 0 | 0 | 0 | 0 | 0 |
| 0.000 | 3.360 | 0.39 | 104500 | 0 | 0 | 0 | 0 | 0 |

| RATIO | ADDITION FLUX lbs. | FINAL TEMP. °F. | FINAL % C | FINAL % SI | FINAL % CR | FINAL % MN | FINAL % Ni | FINAL % Mo |
|---|---|---|---|---|---|---|---|---|
| 0.000 | 2287 | 2972 | 1.240 | 0.240 | 19.630 | 0.640 | 6.370 | 0.25 |
| 3.000 | 0 | 2942 | 1.080 | 0.090 | 19.480 | 0.600 | 6.400 | 0.25 |
| 3.000 | 0 | 2947 | 0.800 | 0.080 | 17.920 | 1.330 | 6.970 | 0.26 |
| 1.000 | 0 | 3071 | 0.340 | 0.080 | 17.650 | 1.300 | 7.040 | 0.26 |
| 3.000 | 0 | 2982 | 0.680 | 0.090 | 18.660 | 0.560 | 6.560 | 0.13 |
| 0.000 | 0 | 2728 | 0.650 | 0.100 | 17.360 | 1.420 | 6.900 | 0.13 |
| 3.000 | 0 | 2952 | 0.450 | 0.100 | 16.800 | 1.160 | 6.990 | 0.13 |
| 1.000 | 0 | 3067 | 0.170 | 0.080 | 16.420 | 1.020 | 6.990 | 0.13 |
| 0.000 | 2030 | 2770 | 1.120 | 0.190 | 18.780 | 0.610 | 6.970 | 0.14 |
| 3.000 | 0 | 2997 | 0.620 | 0.100 | 18.250 | 0.550 | 7.050 | 1.58 |
| 0.000 | 0 | 2690 | 0.680 | 0.110 | 17.150 | 1.370 | 8.370 | 1.55 |
| 3.000 | 0 | 2980 | 0.390 | 0.090 | 16.390 | 1.060 | 8.460 | 1.57 |
| 1.000 | 0 | 3037 | 0.200 | 0.090 | 16.180 | 1.020 | 8.490 | 1.56 |
| 0.333 | 0 | 2889 | 0.038 | 0.090 | 16.000 | 1.000 | 8.500 | 1.57 |
| 0.000 | 2857 | 2680 | 1.390 | 0.230 | 18.300 | 0.560 | 3.850 | 0.19 |
| 4.000 | 0 | 2971 | 0.940 | 0.070 | 18.040 | 0.510 | 3.920 | 0.19 |
| 0.000 | 0 | 2703 | 1.030 | 0.090 | 17.280 | 1.750 | 7.860 | 0.20 |
| 3.000 | 0 | 2972 | 0.550 | 0.080 | 16.750 | 1.470 | 7.960 | 0.21 |
| 1.000 | 0 | 3000 | 0.290 | 0.060 | 16.470 | 1.440 | 8.000 | 0.21 |
| 4.000 | 2393 | 2769 | 1.520 | 0.130 | 18.860 | 0.540 | 6.660 | 0.36 |
| 4.000 | 0 | 2938 | 1.120 | 0.080 | 18.400 | 0.520 | 6.710 | 0.36 |
| 0.000 | 2983 | 2752 | 1.240 | 0.170 | 18.710 | 0.580 | 4.290 | 0.34 |
| 4.000 | 0 | 2943 | 0.850 | 0.170 | 18.450 | 0.540 | 4.290 | 0.35 |
| 3.000 | 0 | 2860 | 0.720 | 0.080 | 16.980 | 1.650 | 7.000 | 0.36 |
| 3.000 | 0 | 2947 | 0.540 | 0.080 | 16.860 | 1.560 | 7.040 | 0.36 |
| 1.000 | 0 | 2977 | 0.410 | 0.080 | 16.690 | 1.540 | 7.060 | 0.36 |
| 0.333 | 0 | 3069 | 0.041 | 0.070 | 16.200 | 1.400 | 7.090 | 0.36 |
| 0.000 | 2533 | 2746 | 1.200 | 0.300 | 18.650 | 0.660 | 3.550 | 2.08 |
| 4.000 | 0 | 3060 | 0.690 | 0.300 | 18.650 | 0.660 | 3.550 | 2.08 |
| 0.000 | 0 | 2456 | 0.690 | 0.100 | 17.530 | 1.390 | 8.400 | 2.07 |
| 3.000 | 0 | 2942 | 0.530 | 0.070 | 16.550 | 1.090 | 8.530 | 2.09 |
| 1.000 | 0 | 3017 | 0.290 | 0.060 | 16.310 | 1.070 | 8.570 | 2.09 |

TABLE-continued

| | | | | | | | | |
|---|---|---|---|---|---|---|---|---|
| 0.000 | 0 | 2781 | 1.580 | 0.170 | 18.960 | 0.600 | 3.640 | 0.39 |

Each network is trained using the standard back propagation paradigm. Training should use either a hyperbolic tangent, or preferably a sigmoid transfer function, a learning rate of 0.1 and a momentum of zero for each neuron. Once the neural network is sufficiently trained, it is translated to a readily usable programming language such as C or BASIC or FORTRAN. The code in one of these languages is compiled and linked as necessary.

A flowchart indicative of the training operation is shown in FIG. 4. Pursuant to Step A the weights and offset are set to small random values between one and minus one. The collected training input and output data for a given process period are then presented to the neural network input neurons 22 under training as indicated in Step B. After the input data is propagated through the inner layer of neurons 26 to the output neurons 24, an output 20 as shown in Step C is formed for each output neuron 24 based on the transfer function $Y_i$ described in Equation (1). The calculated output 20 from the output neurons 24 is compared in Step D to the output data of the given process period to develop an error signal 30 using Equations 5 and 6 for the output and hidden neurons respectively. The error signal 30 is then compared to a preset tolerance factor in Step E. If the error signal 30 is larger than the tolerance factor, the error signal 30 as shown in Step F makes a backward pass through the network using Equation 7 for adjusting the weights to the output and hidden neurons and each weight in Step A is incrementally changed by $\Delta W_i$. Input data of another process period is presented and Steps B through E are repeated until the error signal 30 is reduced to an acceptable level. When the error signal 30 is smaller than the preset tolerance factor the training procedure pursuant to Step G is complete.

For purposes of verification the verification Steps H and I are followed in which test inputs are presented to generate outputs 20 as in Step C for comparison in Step D with known outputs. The tolerance factor is an externally determined standard for the desired accuracy of the neural network. The training is continued until the error signal is less than this tolerance. The simplest form of a tolerance is to assign a certain percentage error for training to stop. A more practical form of tolerance is to test whether the neural network is in fact learning to generalize the relationships between the problem's inputs and outputs or whether it has begun to memorize those relationships for the specific data with which it trains itself. After a periodic number of iterations the neural network is applied to the reserve or test data and its ability to estimate the desired output for that data is assessed. In the early stage of training the neural network will learn to estimate the test outputs with increasing accuracy. After the neural network has completed generalization, it begins to increase its accuracy relative to the training data at the expense of its accuracy relative to the test data. At this point the training is considered to have reached the optimum configuration or weights for general problem solving, and the training process is stopped. Each neural network 1–5 is trained in the aforementioned manner.

The determination of the error signal 30 is a recursire process that starts by generating outputs from the output neurons 24 based on feeding the collected data to the input neurons 22. The input neurons 22 cause a signal to be propagated forward through the neural network until an output signal is produced at the output neuron 24. From equation 3 it can be seen that the learning rate $\eta$ will effect how much the weights are changed each time an error signal is propagated. The larger $\eta$, the larger the changes in the weights and the faster the learning rate at the possible expense of the accuracy that may eventually be obtained.

The total population of collected input and output data should be randomly divided into two groups. The larger group should be used as training data for training the neural network with the remaining smaller group of data used as test data for verification. One reasonable division is to use 75% of the collected data for training purposes and to use the remaining 25% of the collected data as test data to verify the network's predictive accuracy. The neural network should be trained until comparisons to the verification data show that the model's accuracy is not increasing. At this point, those skilled in the art will know that the network is no longer learning to generalize the problem, but is rather memorizing the specific solutions for the training set of data. The learning process typically takes 10,000 to 500,000 presentations of process periods, i.e, presentations of individual sets of complete input and output data for a given process period, to the network for adjustment of its weights. The order of presenting the process periods within the entire training set of data to the neural network for training should be randomly shuffled after each time the entire set has been presented to the network for training.

The sequence of using the trained neural networks 1–5 is determined in accordance with the decarburization logic shown in FIG. 4. The composition, weight and temperature of the bath at the time of transfer to the refining vessel is estimated or measured. The calculations of the solid additions are independently calculated and do not form part of the present invention. The decarburization logic shown in FIG. 4 is an illustrative example of the invention using neural networks 1–5 based on a predetermined initial decarburization oxygen to diluent gas setting and a predetermined oxygen to diluent gas decarburization ratio schedule. The example of FIG. 4 uses a preselected aim temperature level of 3050° F. for a ratio of 4 to 1 oxygen to diluent gas and a ratio schedule of 1, 0.333 and 0 for the successive aim carbon levels of 0.15%C 0.05%C and 0.03%C respectively. The decarburization logic establishes decision trees to determine when to use the neural networks 1–5.

Decarburization proceeds only if the carbon level is above the ultimate aim level of 0.03% C. If the bath temperature is less than 3050° F. and calculated solid additions have yet to be added to the bath, a ratio of 4 to 1 oxygen to diluent gas is selected and neural network 1 is activated to compute the oxygen counts necessary to raise the temperature of the bath to the preselected level of 3050° F. Upon supplying oxygen equal to the computed counts calculated by neural network 1 the neural networks 3, 4 and 5 are activated or fired to compute the updated conditions of carbon content, bath temperature and metal chemistry upon completion of said injection. Neural network 1 is again activated with the aforementioned outputs of neural networks 3, 4 and 5 as the new initial conditions and the required solid additions also used as new inputs to compute the oxygen count necessary to raise the bath temperature to the preselected level of 3050° F. while simultaneously adding said additions. Oxygen is injected at the preselected ratio of 4 to 1 while the said additions are added until the computed oxygen counts are satisfied.

If the bath temperature is less than 3050° F. and no solid additions have yet to be added to the bath, a ratio of 4 to 1 oxygen to diluent gas is selected and neural network 1 is activated to compute the oxygen counts necessary to raise the temperature of the bath to the preselected level of 3050° F. Upon supplying oxygen equal to the computed counts calculated by neural network 1 the neural networks 3, 4 and 5 are activated to compute updated conditions of carbon content, bath temperature and metal chemistry.

If the bath temperature computed by neural networks 3, 4 and 5 equals or exceeds the predetermined aim temperature level of 3050° F. a new ratio of oxygen to diluent gas is specified corresponding to a ratio of 1/1, ⅓ or zero, respectively, with the determination based upon the temperature and carbon concentration such that if the temperature is between 3050° F. and 3100° F. and the carbon concentration exceeds 0.15% the ratio of 1/1 is specified, whereas if the temperature is equal to or greater than 3050° F. and the carbon content is between 0.08% and 0.15% a ratio of ⅓ is specified and finally if the temperature exceeds or equals 3050° F. and the carbon content is less than 0.08% a zero ratio is specified. For any of these conditions neural network 2 is activated, the appropriate oxygen to diluent gas ratio is chosen and the required oxygen gas counts are computed to reach the aim carbon level. Oxygen and/or diluent gas is then blown at the specified ratio until the oxygen counts as computed by neural network 2 are satisfied. The neural networks 3, 4 and 5 are then activated after each successive step to update the bath chemistry, temperature and carbon content for the initial condition of any subsequent decarburization.

An AOD process was run using a conventional thermodynamic model for predicting and controlling the decarburization process during the production of both ASTM 300 series and ASTM 400 series stainless steels. Upon adjusting the constants in the model to attain optimal accuracy, the carbon content could be predicted with a standard deviation of 0.11% carbon for actual carbon contents between 0.1% and 0.3%. Fourteen heats of stainless steels were sampled after the use of each ratio of oxygen to diluent gas to measure the bath chemistry and temperature, The information was used for training the first neural network of the present invention, The trained neural network was then used to predict the carbon content at carbon contents between 0.1% and 0.3% carbon during the production of the same grades of stainless steels, The carbon content prediction using the said neural network had a standard deviation of only 0.035% carbon.

What we claim is:

1. A method for refining steel by controlling the decarburization of a predetermined molten metal bath having a known composition of elements including carbon and having a known or estimated initial temperature and weight at the outset of decarburization of a molten metal bath in a refractory vessel with a process of decarburization performed through the injection of oxygen and a diluting gas into said bath under adjustable conditions of gas flow, comprising the steps of:

(a) training a first neural network to analyze input and output data representative of many process periods of one or more decarburization operations, from data including the bath chemistry, weight and temperature at the outset of each process period, the gas ratio of oxygen to diluent gas used during each process period, the counts of oxygen injected into the bath for each process period, and the final temperature obtained at the conclusion of each process period, until said first neural network is able to provide a substantially accurate output representing the counts of oxygen required to be injected into said predetermined bath at any preselected gas ratio to cause the temperature of the bath to rise to a specified aim temperature level as a result of such gas injection;

(b) training a second neural network to analyze input and output data representative of many process periods of one or more decarburization operations, from data including the bath chemistry, weight and temperature at the outset of each process period, the gas ratio of oxygen to diluent gas used during each process period, the counts of oxygen injected into the bath for each process period and the final carbon content obtained at the conclusion of each process period until said second neural network is able to provide a substantially accurate output schedule of oxygen counts to be injected into said predetermined bath to reduce the carbon level to a predetermined aim level in one or more successive stages corresponding to a preselected schedule of ratios of oxygen to diluent gas;

(c) employing said first neural network to compute the oxygen counts to be injected into said predetermined bath, from its known initial chemistry, weight and temperature at a first preselected ratio of oxygen to diluent gas to raise the bath temperature to a specified aim temperature level.

(d) injecting oxygen and diluent gas into said bath at said first preselected ratio until the oxygen counts computed by said first neural network are satisfied;

(e) employing said second neural network to provide an output schedule of oxygen counts to be injected into said predetermined bath from its known initial chemistry, weight and temperature to successively reduce the carbon level in said bath to a predetermined aim carbon level in one or more stages corresponding to a preselected schedule of ratios of oxygen to diluent gas;

(f) injecting oxygen and diluent gas into said bath at said preselected schedule of oxygen counts corresponding to said output schedule as computed by said second neural network;

(g) training a third neural network to analyze data from the bath chemistry, weight and temperature at the outset of each process period, the weight of each solid addition, if any, made during each process period, the counts of oxygen injected during each process period, the corresponding ratio of oxygen to diluent gas used during each process period and the resulting carbon content at the conclusion of each process period of the purpose of predicting an output representing the carbon content that would be obtained as a result of such oxygen injection; and (h) employing said third neural network to compute the carbon content in the bath upon completion of the injection of oxygen intended as a result of computations performed in at least one of the steps (c) and (e).

2. A method as defined in claim 1 wherein said known composition of elements is selected from the class consisting essentially of carbon, iron, silicon, chromium, manganese, nickel and molybdenum.

3. A method as defined in claim 2 wherein said oxygen and diluent gas are injected into said bath subsurfacely.

4. A method as defined in claim 3 wherein said diluent gas is selected from the group consisting of argon, nitrogen and carbon dioxide.

5. A method as defined in claim 4 wherein said first neural network is trained and used in step (c) prior to the use of said second neural network in step (e).

6. A method as defined in claim 4 wherein at least 10 process periods of data are collected for each oxygen to diluent gas ratio.

7. A method as defined in claim 6 further comprising adding solid additions to said bath during decarburization.

8. A method as defined in claim 7 wherein said solid additions are selected from the group consisting of lime, dolomitic lime, magnesia, ferro-chrome, ferro-manganese, nickel and ferro-nickel.

9. A method as defined in claim 7 wherein said data applied to train said first and second neural networks further comprises the weights of any solid additions added during each of said process periods for use in training said neural networks based on actual conditions of operation using solid additions.

10. A method as defined in claim 9 wherein said first, second, and/or third neural networks have a multiple number of input neurons to receive said input data, one layer of output neurons and at least one layer of hidden neurons with each neuron in each layer interconnected to each neuron in an adjacent layer through adjustable weights.

11. A method as defined in claim 10 wherein each neural network is trained by comparing the output generated from its output neurons to the output data for a corresponding process period or set of process periods; generating an error signal from such comparison, comparing said error signal to a predetermined tolerance factor and modifying the weights between neuron layers until said error signal is equal to or below said tolerance factor.

12. A method as defined in claim 11 wherein the output of the neural network under training is tested against test data to verify the accuracy of the neural network output.

13. A method as defined in claim 1 further comprising the steps of:

training a fourth neural network to analyze data from the bath chemistry, weight and temperature at the outset of each process period, the weight of each solid addition, if any, made during each process period, the counts of oxygen injected during each process period, the corresponding ratio of oxygen to diluent gas used during each process period, and the resulting temperature at the conclusion of each process period for the purpose of providing an output representing the temperature reached as a result of such oxygen injection; and employing said fourth neural network to compute the temperature of the bath upon completion of the injection of oxygen.

14. A method as defined in claim 13 further comprising the steps of:

training a fifth neural network to analyze data from the bath chemistry, weight and temperature at the outset of each process period, the weight of each solid addition, if any, made during each process period, the counts of oxygen injected during each process period, the corresponding ratio of oxygen to diluent gas used during each process period and the resulting chemistry at the conclusion of each process period for the purpose of providing an output representing the chemistry content of the bath as a result of such oxygen injection; and employing said fifth neural network to compute the chemistry content of the bath upon completion of the injection of oxygen.

* * * * *